US007187325B2

(12) United States Patent
Subotic et al.

(10) Patent No.: US 7,187,325 B2
(45) **Date of Patent: *Mar. 6, 2007**

(54) METHODS AND APPARATUS FOR RECONFIGURING ANTENNA ARRAY PATTERNS

(75) Inventors: Nikolas Subotic, Ann Arbor, MI (US); Christopher Roussi, Kalamazoo, MI (US); Joseph Burns, Ann Arbor, MI (US); Vincent Canella, Beverly Hills, MI (US)

(73) Assignee: Altarum Institute, Ann Arbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/348,737

(22) Filed: Jan. 22, 2003

(65) Prior Publication Data

US 2005/0259004 A1 Nov. 24, 2005

Related U.S. Application Data

(63) Continuation-in-part of application No. 10/216,602, filed on Aug. 9, 2002, now Pat. No. 6,774,844.

(60) Provisional application No. 60/350,787, filed on Jan. 22, 2002, provisional application No. 60/311,267, filed on Aug. 9, 2001.

(51) Int. Cl.
*H01Q 3/22* (2006.01)
*H01Q 3/00* (2006.01)

(52) U.S. Cl. ..... 342/374; 342/368; 342/375; 342/377; 343/700 MS

(58) Field of Classification Search ..... 342/374, 342/368, 372, 377, 375; 343/700 MS
See application file for complete search history.

(56) References Cited

U.S. PATENT DOCUMENTS 4,728,805 A * 3/1988 Dempsey ..... 342/374

(Continued)

OTHER PUBLICATIONS

S.E. El-Khamy, On the application of modern signal processing techniques in the design of antenna arrays for wireless communications, 11th Mediterranean Electrotechnical Conference, MELECON 2002, p. 115, May 2002.*

(Continued)

*Primary Examiner*—Thomas H. Tarcza
*Assistant Examiner*—F H Mull
(74) *Attorney, Agent, or Firm*—Gifford, Krass, Sprinkle, Anderson & Citkowski, P.C.

(57) ABSTRACT

A substrate is provided with a multiplicity of electrically conductive elements, and the elements are interconnected to form an antenna structure for desired application. Either the antenna pattern itself may be altered according to the invention, or one or more feed points may be changed, or all of the above. As such, the electrically conductive elements may be interconnected to change the directionality of the antenna pattern, the gain, the frequency response, or other operational characteristics. The electrically conductive elements may be arranged in the form of an inchoate antenna pattern or regular array. Switches at key points of the structure enable the pattern to be changed dynamically. Such switching may be carried out in real time in accordance with transmissions/reception characteristics, or in advance using simulations associated with the switched elements.

1 Claim, 13 Drawing Sheets

U.S. PATENT DOCUMENTS

| | | | | |
|---|---|---|---|---|
| 6,175,723 | B1 * | 1/2001 | Rothwell, III | 455/63.1 |
| 6,392,610 | B1 * | 5/2002 | Braun et al. | 343/876 |
| 6,525,691 | B2 * | 2/2003 | Varadan et al. | 342/700 MS |
| 6,774,844 | B2 * | 8/2004 | Subotic et al. | 342/374 |
| 2003/0034918 | A1 * | 2/2003 | Werner et al. | 343/700 MS |
| 2003/0052818 | A1 * | 3/2003 | Subotic et al. | 342/377 |

OTHER PUBLICATIONS

S. Mummareddy et al., Genetic optimization of fractal dipole antenna arrays for compact size and improved impedance performance over scan angle, IEEE Antennas and Propagation Society International Symposium, vol. 4, p. 98-101, Jun. 2002.*

G. Makri, The Strange World of Fractals, http://users.forthnet.gr/ath/kimon/Fractals/Fractal.html, Mar. 2001.*

* cited by examiner

Self-similar structure (Fractal)

A-subset, e.g. ▲
Hutchinson operator W
Similarity transform
(rotation, translation, scale)

$$W[A] = w_1[A] \cup w_2[A] \cup \Lambda \cup w_N[A]$$

$$\begin{pmatrix} x' \\ y' \end{pmatrix} = \begin{pmatrix} r\cos\phi & -r\cos\phi \\ r\sin\phi & r\cos\phi \end{pmatrix} \begin{pmatrix} x \\ y \end{pmatrix} + \begin{pmatrix} x_0 \\ y_0 \end{pmatrix}$$

$$A_1 = W[A]$$

$$A_2 = W[W[A]]$$

$$\mathrm{M}$$

$$A_n = W[A_{n-1}]$$

Iterate the *same* Hutchinson operator
Multi-freq.: $\lambda_n = r^n \lambda_0$
Same behavior at each freq.

FIG. - 10A

Self-affine structure

Hutchinson operator W
Affine linear transform
(rot., trans., scale, skew, refl.)

$$W[A] = w_1[A] \cup w_2[A] \cup \Lambda \cup w_N[A]$$

$$\begin{pmatrix} x' \\ y' \end{pmatrix} = \begin{pmatrix} r\cos\phi & -s\cos\psi \\ r\sin\phi & s\cos\psi \end{pmatrix} \begin{pmatrix} x \\ y \end{pmatrix} + \begin{pmatrix} x_0 \\ y_0 \end{pmatrix}$$

$$A_1 = W[A]$$

$$A_2 = W[W[A]]$$

$$\mathrm{M}$$

$$A_n = W[A_{n-1}]$$

Iterate the *same* Hutchinson operator

Multi-freq.: $\lambda_n = s^{n/2} r^{n/2} \lambda_0$

Different radiation patterns

FIG. - 10B

Hausdorff structure

Hutchinson operator W
Affine linear transform $$W[A] = w_1[A] \cup w_2[A] \cup \Lambda \cup w_N[A]$$

$$\begin{pmatrix} x' \\ y' \end{pmatrix} = \begin{pmatrix} r\cos\phi & -s\cos\psi \\ r\sin\phi & s\cos\psi \end{pmatrix} \begin{pmatrix} x \\ y \end{pmatrix} + \begin{pmatrix} x_0 \\ y_0 \end{pmatrix}$$

$$A_1 = W_1[A]$$

$$A_2 = W_2[W_1[A]]$$

M $$A_n = W_n[W_{n-1}[\Lambda\ W_1[A]]]$$

FIG. - 10C

Hausdorff structure

A-subset, e.g. ▲
Hutchinson operator W
Affine linear transform $$W[A] = w_1[A] \cup w_2[A] \cup \Lambda \cup w_N[A]$$

$$\begin{pmatrix} x' \\ y' \end{pmatrix} = \begin{pmatrix} r\cos\phi & -s\cos\psi \\ r\sin\phi & s\cos\psi \end{pmatrix} \begin{pmatrix} x \\ y \end{pmatrix} + \begin{pmatrix} x_0 \\ y_0 \end{pmatrix}$$

$$A_1 = W_1[A]$$

$$A_2 = W_2[W_1[A]]$$

$$\mathrm{M}$$

$$A_n = W_n[W_{n-1}[\Lambda\ W_1[A]]]$$

Sequence of *different*
Hutchinson operators
Multi-freq.: $\lambda_n$-arbitrary
Different radiation patterns

FIG. – 10D

Generalized Hausdorff structure $A^m$-subset, e.g. ▲ ■ ◠

Hutchinson operator W

Affine linear transform $$W[A^1 \Lambda A^m] = w_1[A^1 \Lambda A^m] \cup w_2[A^1 \Lambda A^m] \cup \Lambda \cup w_N[A^1 \Lambda A^m]$$

$$\begin{pmatrix} x' \\ y' \end{pmatrix} = \begin{pmatrix} r\cos\phi & -s\cos\psi \\ r\sin\phi & s\cos\psi \end{pmatrix} \begin{pmatrix} x \\ y \end{pmatrix} + \begin{pmatrix} x_0 \\ y_0 \end{pmatrix}$$

$$A'_1 = W_1[A^1 \Lambda A^m]$$

$$A'_2 = W_2[W_1[A^1 \Lambda A^m]]$$

M $$A'_n = W_n[W_{n-1}[\Lambda W_1[A^1 \Lambda A^m]]]$$

Sequence of *different* Hutchinson operators on *different* subsets

Multi-freq.: $\lambda_n$-arbitrary

Radiation patterns: variable

Polarization: variable

FIG. – 10E

METHODS AND APPARATUS FOR RECONFIGURING ANTENNA ARRAY PATTERNS

REFERENCE TO RELATED APPLICATIONS

This application claims priority from U.S. Provisional Patent Application Ser. No. 60/350,787, filed Jan. 22, 2002, and is a continuation-in-part of U.S. patent application Ser. No. 10/216,602, filed Aug. 9, 2002 now U.S. Pat. No. 6,774,844 , the entire contents of both applications being incorporated herein by reference.

FIELD OF THE INVENTION

This invention relates generally to radio-frequency (RF) antennas, and, in particular, to hardware and software for reconfiguring antenna array patterns.

BACKGROUND OF THE INVENTION

The design of RF antennas can be exceedingly complex and mathematically and empirically intense due to the wide range of tradeoffs involving frequency response, sensitivity, directionality, polarizations, and so forth. Conventional antennas, such as open loops and parallel element arrays are limited in terms of applicability, such that, quite often, a particular geometry is relegated to a dedicated frequency band or direction.

It has been found that so-called fractal antennas offer certain advantages over conventional designs, including smaller size and desirable performance at multiple frequencies. In addition to greater frequency independence, such antennas afford enhanced radiation, since the often large number of sharp edges, corners, and discontinuities each act as points of electrical propagation or reception.

The term 'fractal' was coined by Benoit Mandelbrot in the mid-70s to describe a certain class of objects characterized in being self-similar and including multiple copies of the same shape but at different sizes or scales. Fractal patterns and multi-fractal patterns have by now been widely studied, and further information on fractal designs may be found in *Frontiers in Electromagnetics*, IEEE Press Series on Microwave Technology and RF, 2000, incorporated herein by reference.

Fractal antennae were first used to design multi-frequency arrays. The Sierpinski gasket antenna, which resembles a triangle packed with differently sized triangles of the same general orientation, was the first practical antenna to maintain performance at several (5) bands. Other fractal geometries used in antenna design include the Sierpinski carpet, which may be viewed as a square-within-a-square version of the Sierpinski gasket, as well as the snowflake or Koch curve, which has also been used in monopole form.

In designing an antenna based upon a folded or convoluted fractal-type geometry, the resonance frequencies may be a function of multiple parameters, including the shape of the structuring or replicated element, the size of the smallest element, and the number of scaling factors used simultaneously in the pattern. Despite the improved performance of antennas based upon fractal geometries, existing designs exhibit certain disadvantages. In particular, though self-similar, conventional fractals are based upon a heterogeneous reproduction of structuring elements limited to transformations in terms of rotation, translation, and scale, fractal structures utilize a subset of a Hutchinson operator W, wherein a regular shape, such as a triangle or square is iterated such that the same behavior may be obtained, albeit at multiple frequencies. Increased degrees of freedom are required to design structures with appropriate gain, beam patterns, polarization response, and other desirable characteristics.

SUMMARY OF THE INVENTION

This invention resides in methods and apparatus for reconfiguring an antenna array pattern. In the preferred embodiment, a substrate is provided with a multiplicity of electrically conductive elements, and the elements are interconnected to form an antenna pattern for desired application.

Either the pattern itself may be altered according to the invention, or one or more feed points may be changed, or all of the above. As such, the electrically conductive elements may be interconnected to change the directionality of the antenna pattern, the gain, the frequency response, or other operational characteristics.

The electrically conductive elements may be arranged in the form of an inchoate antenna pattern or regular array. Switches at key points of the structure enable the pattern to be changed dynamically. Such switching may be carried out in real time in accordance with transmissions/reception characteristics, or in advance using simulations associated with the switched elements. The switches may be implemented with any appropriate technology, including electrical switches such as MOSFETs, though, in the preferred embodiment, MEMS mechanical switches are used to ensure that the resulting pattern includes continuous metalization for the least amount of leakage and unwanted artifacts.

As an alternative to a fixed pattern with switches used to swap elements or change feed points, a reconfigurable multi-dimensional array may be used having an active area optimized to maximize reception for a desired frequency and/or direction. This aspect of the invention may exploit flat-panel technology, wherein, for example, a transparent conductor array 'face' may be mapped to an addressable interconnect back plane to achieve a desired level of reconfigurability.

BRIEF DESCRIPTION OF THE DRAWINGS

FIG. 10A presents operators and equations having to do with self-similar (fractal) structures:

FIG. 10B presents operators and equations having to do with self-affine structures;

FIG. 10C presents operators and equations having to do with Hausdorff structures;

FIG. 10D presents operators and equations having to do with a sub-set of Hausdorff structures; and FIG. 10E presents operators and equations having to do with generalized Hausdorff structures.

DETAILED DESCRIPTION OF THE INVENTION

Broadly according to this invention, an antenna pattern is placed on the surface of a three-dimensional object, enabling directionality and other factors to be adjusted independently of the orientation of the object during use. In the preferred embodiment, self-replicating or fractal-type antenna patterns are used on a polyhedron, though, in alternative embodiments, other types of antenna patterns, including conventional or non-fractal patterns may be used on objects without flat faces, including spheres, partial hemispheres, and so forth.

Figure 1:
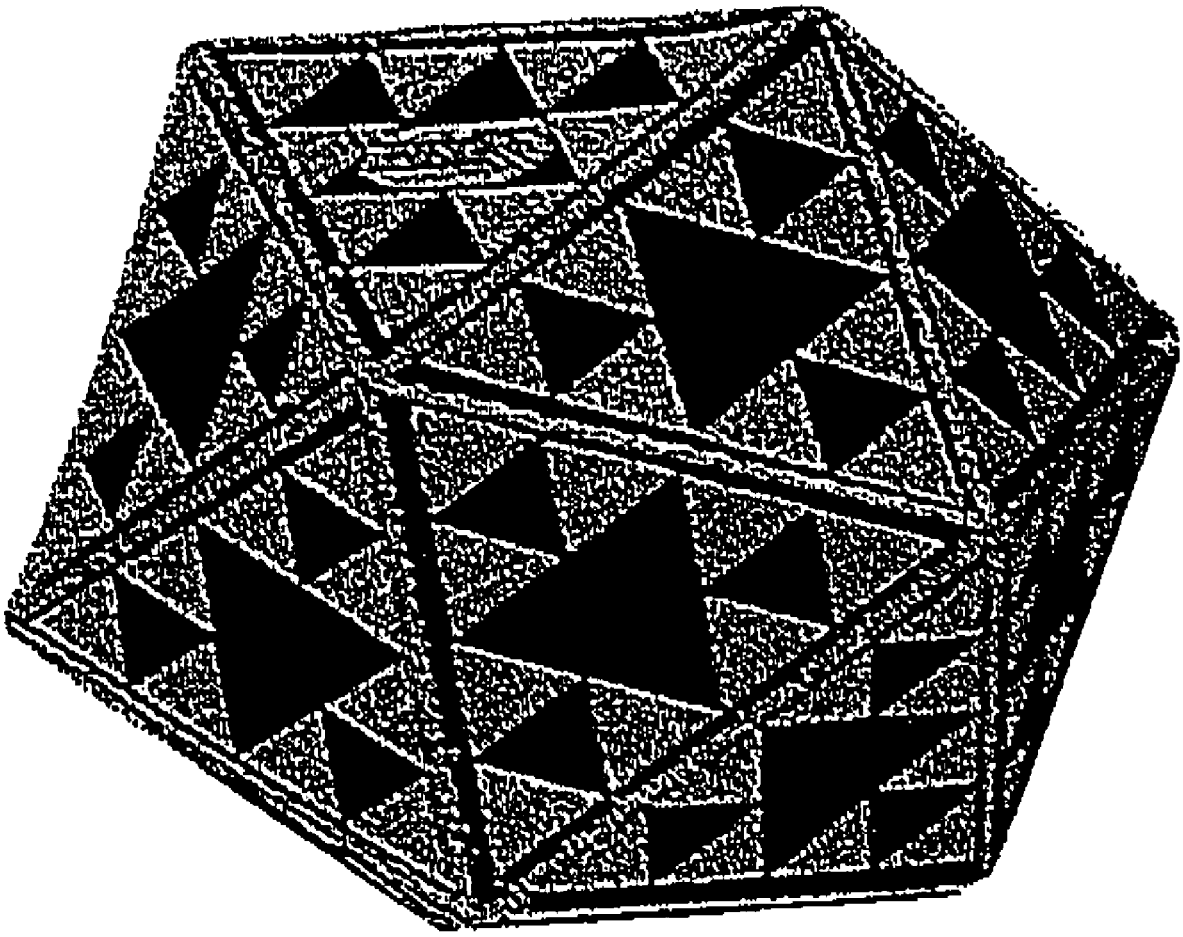
FIG. 1 is an illustration of a fractal antenna array disposed on a polyhedron according to the invention.

FIG. 1 illustrates the preferred embodiment of a fractal antenna pattern disposed on the faces of an icosahedron, in this case the antenna being of the so-called Sierpinski gasket configuration, chosen for the fact that replication results in a triangle at any scaling, allowing for very efficient tiling on the surface of the object.

While antenna-bearing objects according to the invention of the type shown in FIG. 1 may be placed on solid structures with feed lines connected to transmitter and/or receiver circuitry, in the preferred embodiment, the object the hollow, enabling at least certain electronics to be contained within, including wireless communications devices for interaction with other objects and/or base stations. For example, high-frequency components may be placed within the object, with external communications being conducted at a different frequency or lower frequency.

Use of the invention has many advantages, including the capability of providing proper channel geometry regardless of orientation. As such, objects of the type shown in FIG. 1 may be dropped into an environment and electronically oriented regardless of physical orientation. Using small objects of, say, a foot or less in diameter, this could be very useful for surveillance purpose, battlefield communications, and so forth. In the preferred embodiment, each face or portion of the overall antenna structure is steerable via switched feed points, enabling directionality, gain, frequency response and other characteristics to be optimized during use.

Figure 2:
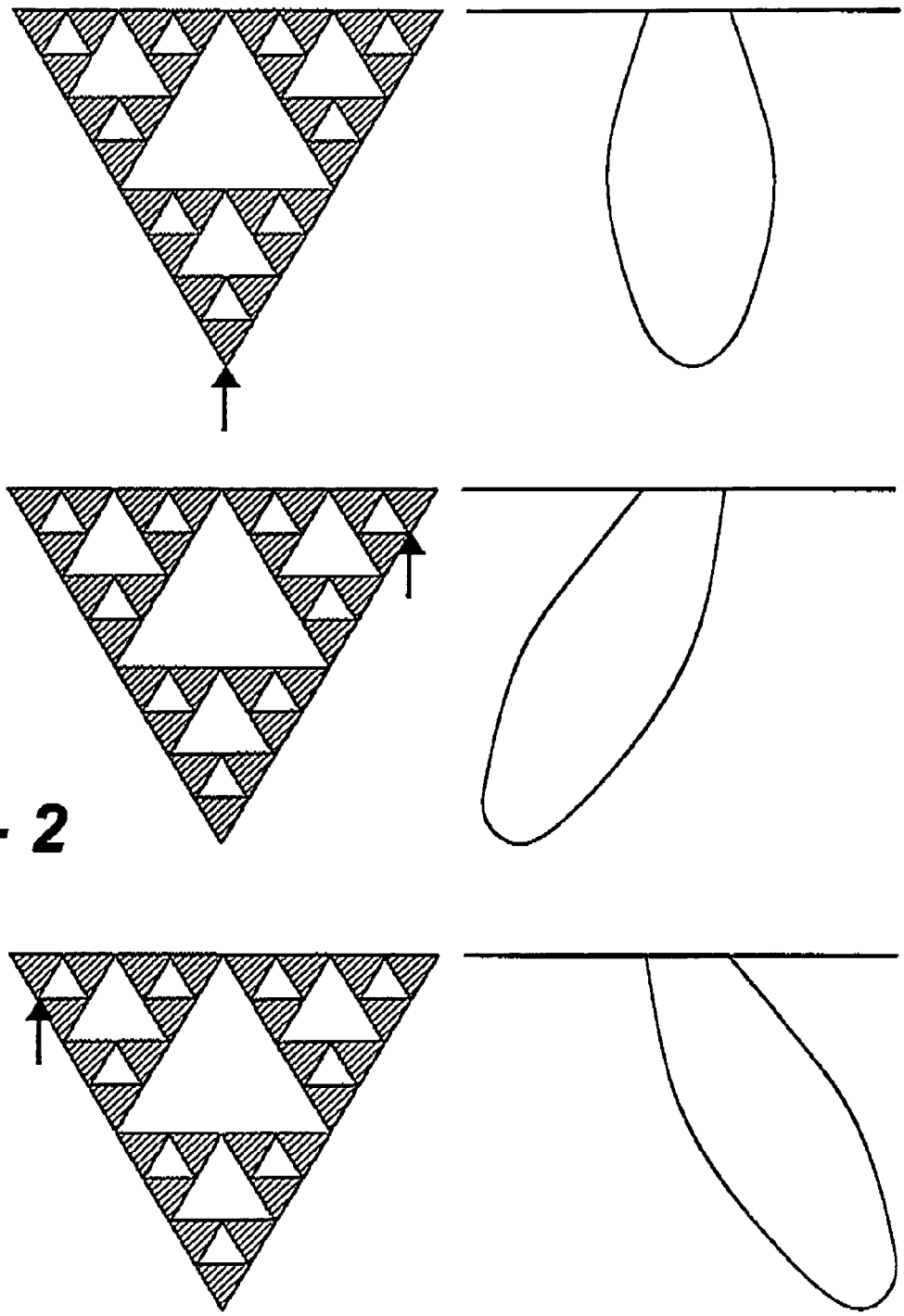
FIG. 2 is a drawing which notionally shows the way in which different feed points may be used to change an antenna's directivity.

As shown notionally in FIG. 2, by changing the feed points of a Sierpinski gasket at the points indicated with the arrows, directivity may be altered, as shown in the patterns on the right side of the figure. To arrive at a desired feed-point configuration, the object according to the invention may initially or periodically conduct a self-testing operation, and different faces and feed points are tested to determine the optimal gain or reception. Such tests may be conducted with other objects, base stations, or satellites, until desired characteristics have been optimized. Following this electronic procedure, the device may commence active functioning, perhaps entering into another test mode if it is moved relative to external communications devices or frequencies.

Figure 3C:
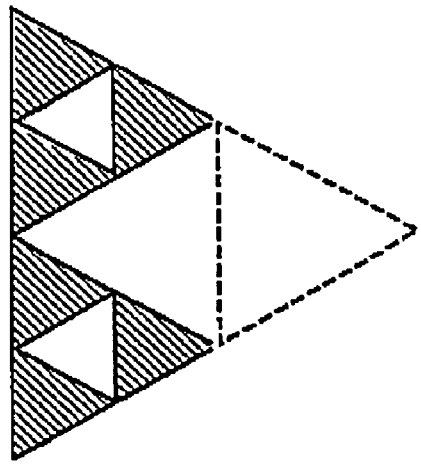
FIG. 3 depicts the fault tolerance of a fractal array.
Figure 3B:
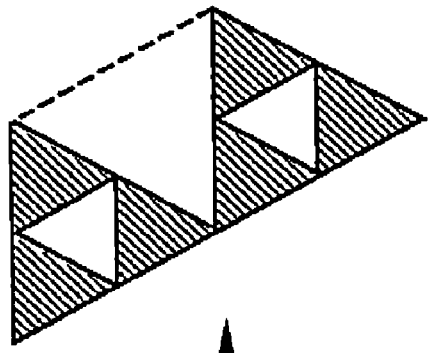
Figure 3A:
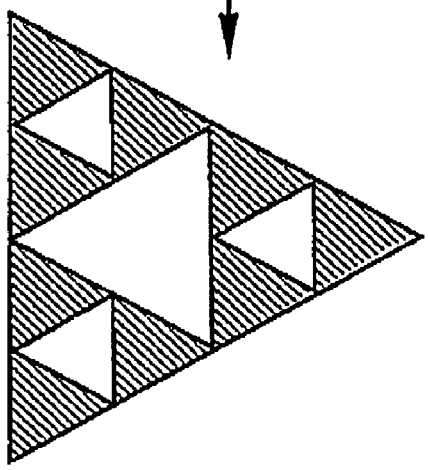

Another advantage of utilizing a fractal-type antenna according to the invention is fault tolerance. As shown in FIG. 3, the current distribution in certain types of self-replicating arrays suggest that the antenna can remain responsive even with faults. Such faults may be very localized, particularly at certain frequencies, such that the loss of a part of the array in FIG. 3A, may have minimal affect on overall performance, as shown in FIG. 3B. As shown in FIG. 3C, by changing the feed-point, frequency response may be maintained even if a portion of the array has been lost.

Figure 4:
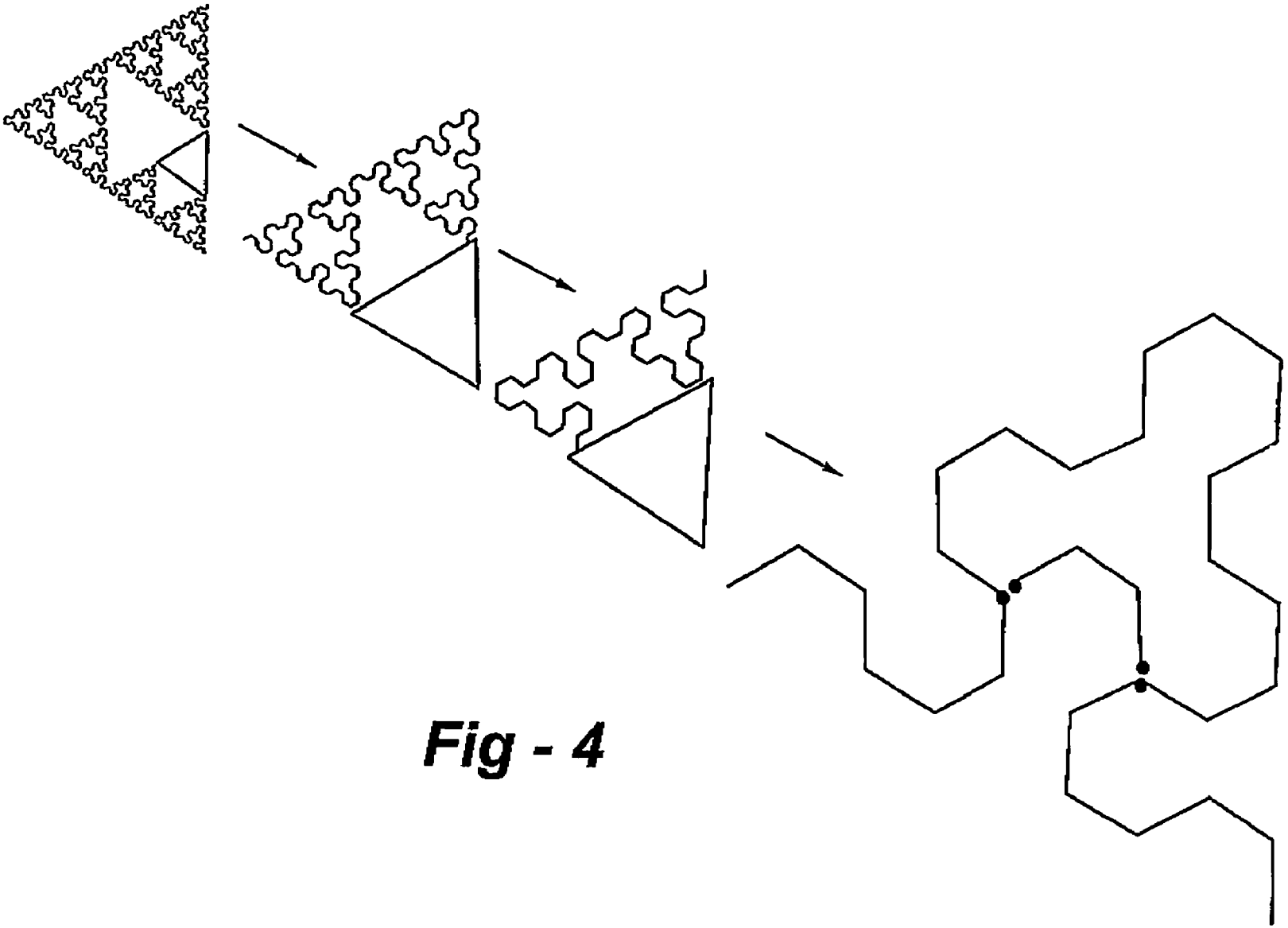
FIG. 4 is a drawing that shows Sierpinski tiling.

In addition to feed-point variability, different linear portions of antenna structures used by the invention may be switched independently, thereby changing the overall pattern as well as feed-points. As shown in FIG. 4, the tiling of a Sierpinski structure is relatively straight forward utilizing the switching of elements to and from the array. The affect can also be easily modeled and tested, again, to ensure optimal performance.

Based upon a priori or real-time performance computations, an antenna pattern according to the invention may be etched or otherwise applied to the surface of an object with appropriate interconnections being made for a given application. It may be more advantageous, however, if a configurable pattern could be used to assume a variety of shapes, thereby lowering production costs. In any case, a dynamic reconfigurable antenna array is possible, enabling a single device to be simultaneously tuned to different or multiple frequencies or other response criteria.

Figure 5:
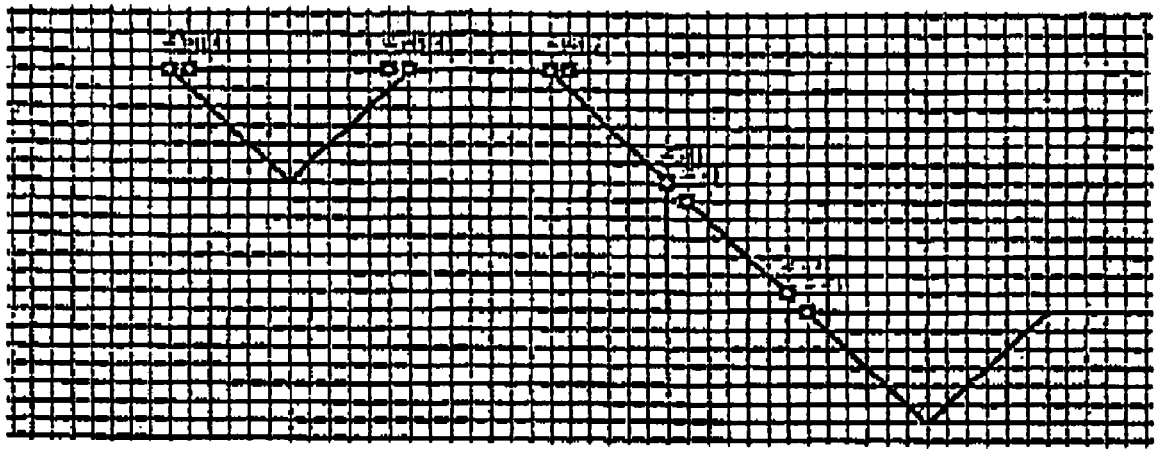
FIG. 5 is a drawing which shows the way in which switches may be used to configure an antenna geometry according to a different aspect of the invention.

According to a broad implementation, once a particular antenna architecture is defined, switches are placed at key points of the structure enabling the pattern to be changed dynamically, as shown in FIG. 5. This figure shows a portion of the pattern with switch points indicated in the array. Although this could be done in real time in accordance with transmissions/reception characteristics, a more preferable approach is to change the pattern and verify the simulations in accordance with the switched elements.

The switches may be implemented with any appropriate technology, including electrical switches such as MOSFETs, though, in the preferred embodiment, MEMS mechanical switches are used to ensure that the resulting pattern includes continuous metalization for the least amount of leakage and unwanted artifacts.

As discussed elsewhere herein, the antenna array may be made directional in its radiation (or reception) pattern either by changing the configuration of the array, changing the feed points in the array, or electrically steering the pattern using standard beam formatting techniques on multiple taps.

Figure 6:
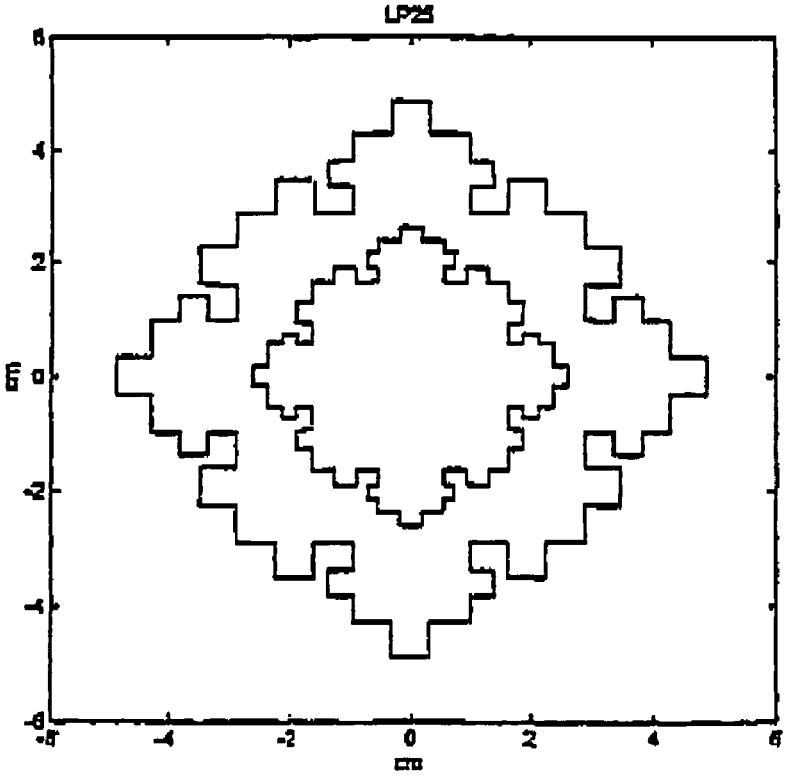
FIG. 6 shows the way in which multiple antenna structures may be placed within the same spatial footprint to permit reception over more frequency bands.
Figure 7:
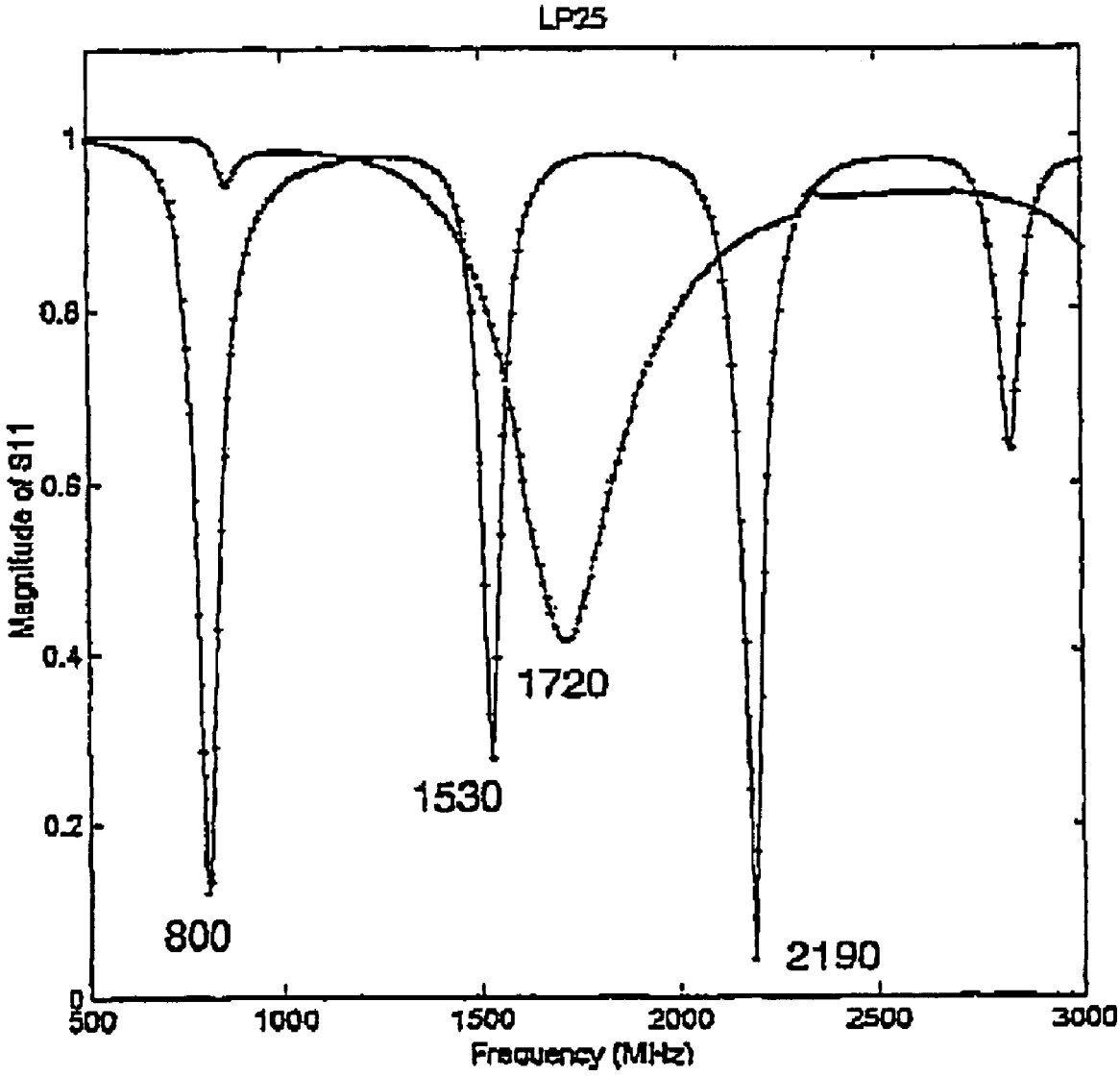
FIG. 7 is a plot showing frequency response for the embedded structure of FIG. 6.

In addition to the use of variable scaling, geometric patterns, and the like, according to the invention, multiple structures may be placed within the same spatial footprint to permit reception over more bands, as shown in FIG. 6. FIG. 7 is a drawing which provides response simulations performed with both structures present, illustrating how embedded structures may be used to accommodate additional frequency bands. According to the invention, such embedded structures may be employed over a portion or all of the surface area of the object.

Figure 8A:
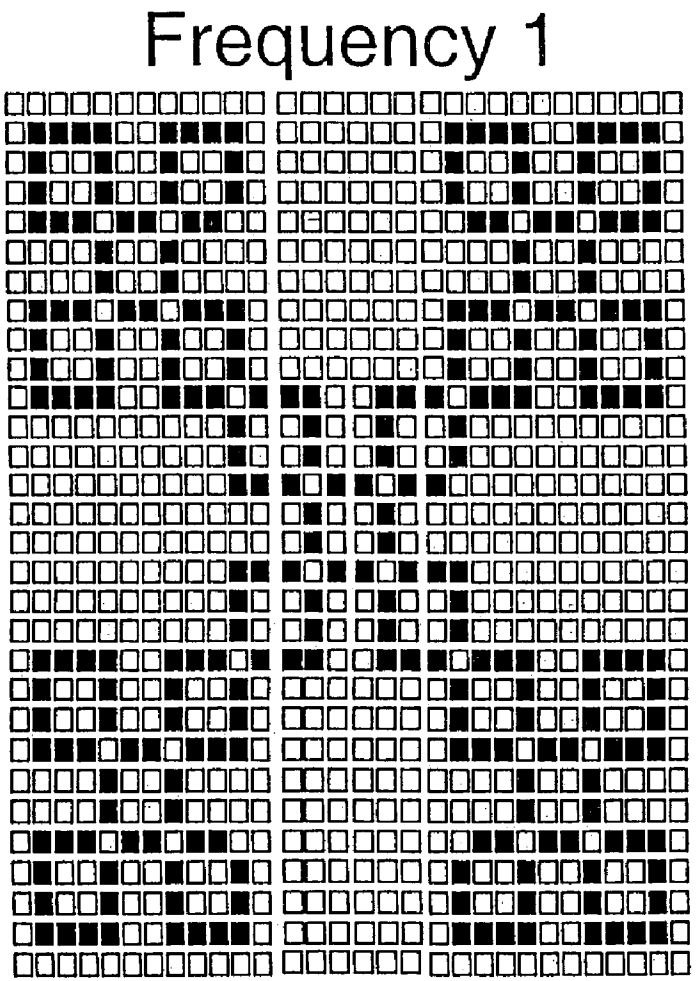
FIG. 8A shows a first frequency response for a reconfigurable array according to the invention.
Figure 8B:
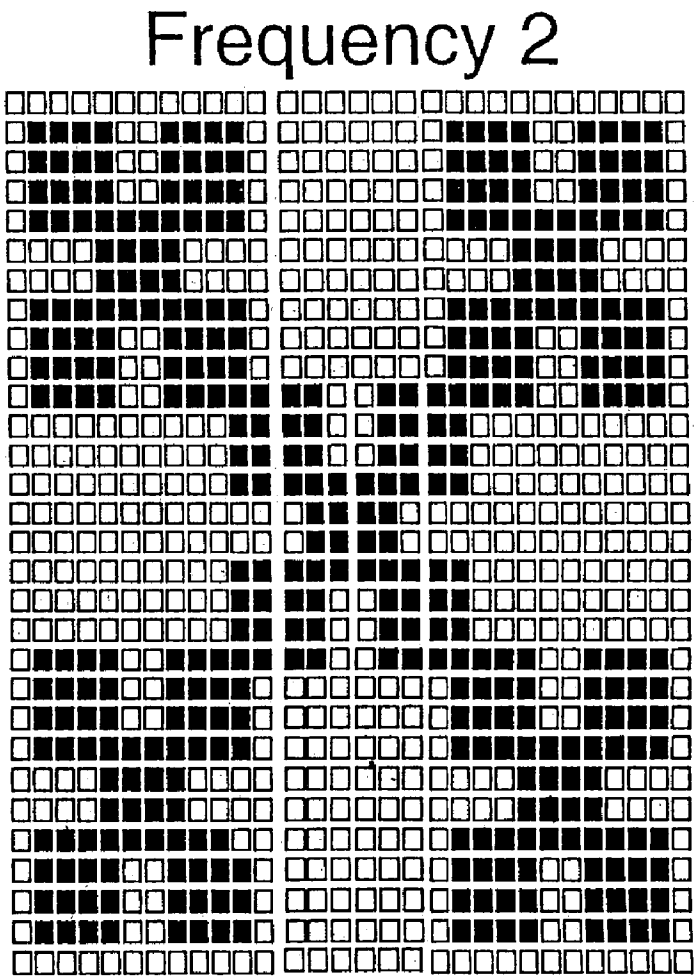
FIG. 8B illustrates a second frequency response for the reconfigurable array of FIG. 8A.
Figure 9:
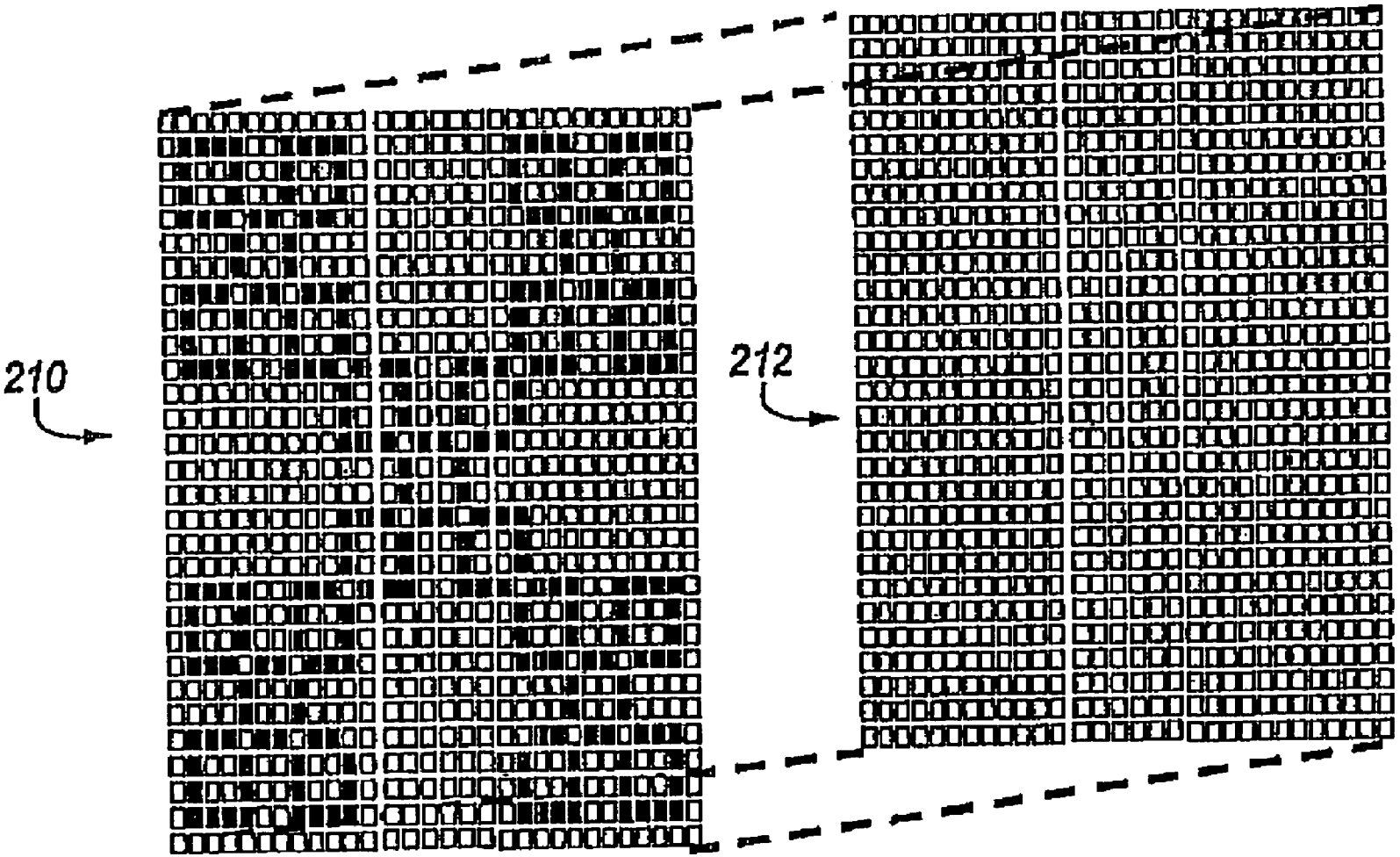
FIG. 9 illustrates the way in which flat-panel technology may be exploited to adaptively activate areas to achieve a reconfigurable antenna pattern according to the invention.

As an alternative to a fixed pattern with switches used to swap elements or change feed points, a reconfigurable multi-dimensional array may be used having an active area optimized to maximize reception for a desired frequency and/or direction. FIG. 8A shows the way in which an array maybe reconfigured for a first frequency, with FIG. 8B showing the way in which the array may be reconfigured for a different frequency. This aspect of the invention may exploit flat-panel technology, as shown in FIG. 9, wherein a conductor array face 210 on the three-dimensional object may be mapped to an addressable interconnect back plane 212 to achieve reconfigurability.

Even in terms of fractal-type patterns, the invention is not limited to conventional geometries such as Koch and Sierpinski shapes, and may be extended to more generalized, self-replicating patterns formed through the use of multiple structural transformations and candidate shapes, as described in co-pending U.S. patent application Ser. No. 10/216,602, incorporated herein by reference.

One improvement over the self-similar fractal structure is the self-affine structure, which, in addition to fractal-type operators permits skewing, reflection (i.e., flipping). Hausdorff structures may also be used, and, in fact, multiple instances of the structure may be deployed to enhance variability and design freedom. Whereas the self-affine structure utilizes a single Hutchinson operator W, according to one use of the Hausdorff structure consistent with this invention, different Hutchinson operator ($W_1$ $W_2$ . . . $W_n$) are utilized to realize $\lambda_n$-arbitrary different radiation patterns at multiple frequencies.

Furthermore, whereas a more limited Hausdorff structure may be based upon a single type of geometry (such as a triangle), a more generalized approach according to the invention permits a sequence of different Hutchinson operators on different subsets thereby realizing patterns which are not only arbitrary in terms of wavelengths/frequency, but also permit variable radiation patterns and variable polarization criteria inherit in the approach.

We claim:

1. A method of reconfiguring an antenna pattern, comprising the steps of:

providing a substrate with a multiplicity or electrically conductive elements;

developing an antenna structure for desired application;

interconnecting the electrically conductive elements to form the structure; and wherein the interconnected elements form a Hausdorff structure.

* * * * *